US006599336B2

(12) United States Patent
Hamada

(10) Patent No.: US 6,599,336 B2
(45) Date of Patent: Jul. 29, 2003

(54) LOW POLLUTION FUEL

(76) Inventor: Yoshiro Hamada, 1010-1, Totsukacho, Totsuka-ku, Yokohama-shi, Kanagawa-ken (JP)

( * ) Notice: Subject to any disclaimer, the term of this patent is extended or adjusted under 35 U.S.C. 154(b) by 0 days.

(21) Appl. No.: 09/840,830

(22) Filed: Apr. 25, 2001

(65) Prior Publication Data

US 2001/0045053 A1 Nov. 29, 2001

(30) Foreign Application Priority Data

Apr. 26, 2000 (JP) ..... 2000-126024

(51) Int. Cl.[7] ..... C10L 1/18

(52) U.S. Cl. ..... 44/445; 44/446; 44/447; 44/448; 44/438; 44/444

(58) Field of Search ..... 44/438, 444, 445, 44/446, 447, 448

(56) References Cited

U.S. PATENT DOCUMENTS 1,363,870 A * 12/1920 Hayes ..... 44/446
1,378,858 A * 5/1921 Hayes ..... 44/446
1,471,566 A * 10/1923 Murphy ..... 44/446
1,474,982 A * 11/1923 Schreiber ..... 44/446
4,603,662 A * 8/1986 Norton et al. ..... 123/1 A
4,682,984 A * 7/1987 Epler ..... 44/443
5,425,790 A * 6/1995 Liotta et al. ..... 44/443
6,324,827 B1 * 12/2001 Basu et al. ..... 60/39.461

FOREIGN PATENT DOCUMENTS

CN 1092800 A * 9/1994
CN 1216317 A * 5/1999
CN 1246522 A * 3/2000
RO 112746 B1 * 12/1997

* cited by examiner

*Primary Examiner*—Cephia D. Toomer
(74) *Attorney, Agent, or Firm*—Wenderoth, Lind & Ponack, L.L.P.

(57) ABSTRACT

To provide a low pollution fuel capable of obviating imperfect combustion of fuel in a diesel engine, etc., and fundamentally solving the exhaust gas problems without depending on the conventional symptomatic method. The low pollution fuel is composed of kerosene, light oil or heavy oil which is blended with an oxygen-contained hydrocarbon composed of an olefin-based hydrocarbon as a starting material, such as ether, alcohol or glycol.

2 Claims, No Drawings

LOW POLLUTION FUEL

BACKGROUND OF THE INVENTION

1. Field of the Invention

This invention relates to a low pollution fuel used for a diesel engine, etc.

2. Related Art

Exhaust gas of a diesel engine contains a large quantity of harmful substances such as suspended particulate matter, nitrogen oxide, hydrocarbons and aldehyde. Those substances often prove themselves to be a main cause for air pollution and pollution-related diseases.

It is extremely difficult to completely bum kerosene, light oil or heavy oil which is currently used as the fuel for a diesel engine by compression combustion that is a diesel engine-specific combustion type. For this reason, the above-mentioned exhaust gas problems occur.

In order to solve such an exhaust gas problems as just mentioned, various kinds of exhaust gas processing devices have been proposed, which include a filter function and a secondary combustion function to be attached to an outlet port of the exhaust gas. However, they still had the following problems. Those devices are likely to be deteriorated with the passage of time and as a result, the performance is degraded. Those devices are expensive and in addition, they have too many technical problems to effectively obviate the above-mentioned cause for air-pollution. Therefore, the above-proposals are not yet satisfactory to solve the outstanding problems fundamentally.

The present invention has been accomplished in view of the above problems inherent in the conventional devices.

SUMMARY OF THE INVENTION

It is, therefore, an object of the present invention to provide a novel low pollution fuel which is extremely superior both in combustion efficiency and in economic efficiency and which can fundamentally solve the above-mentioned problems inherent in the conventional devices by taking the place of kerosene, light oil or heavy oil which was a cause for the harmful exhausts, instead of solving those problems by a symptomatic method, thus enabling to contribute to the solution of the above-mentioned exhaust gas problems.

Another object of the present invention is to provide a novel low pollution fuel which is capable of supplementing the performance of the various kinds of exhaust gas processing devices.

To achieve the above objects, according to the present invention, there is provided a low pollution fuel composed of kerosene, light oil or heavy oil which contains ether alone, or both ether and alcohol, wherein said ether is dimethylether dissolved in a solvent and liquefied.

From another aspect of the present invention, there is provided a low pollution fuel composed of kerosene, light oil or heavy oil which contains ether, wherein said ether is diethylether.

As one suitable example, the diethylether is composed of olefin-based hydrocarbon as a starting material.

From a further aspect of the present invention is to provide a low pollution fuel composed of kerosene, light oil or heavy oil which contains ether, wherein the ether is one or two or more kinds of diethyleneglycolmonoethylether, diethyleneglycolmonomethylether, or diethyleneglycolmonobutylether.

As one suitable example, the diethyleneglycolmonoethylether, diethyleneglycolmonomethylether, or diethyleneglycolmonobutylether is composed of olefin-based hydrocarbon as a starting material.

The low pollution fuel contains one or two or more kinds of glycol, acetal, ketal or ester together with the liquefied dimethylether or diethylether, diethyleneglycolmonoethylether, diethyleneglycolmonomethylether, or diethyleneglycolmonobutylether.

In the above-mentioned fuel, an oxygen-contained hydrocarbon composed of liquefied dimethylether or diethylether, or diethyleneglycolmonoethylether, diethyleneglycolmonomethylether, or diethyleneglycolmonobutylether itself is burnt to obviate the imperfect combustion of fuel, while enhancing the combustion efficiency of the kerosene, light oil or heavy oil.

DETAILED DESCRIPTION OF THE INVENTION

A liquefied hydrocarbon contains an oxygen-contained hydrocarbon which is composed of olefin-based hydrocarbon as a starting material.

A representative example of the liquefied hydrocarbon is kerosene, light oil or heavy oil.

Olefin-based hydrocarbon (alkene) is expressed by R—CH═CH2. Examples are ethylene, propylene, butylene and the like.

A method for manufacturing the oxygen-contained hydrocarbon will now be described.

(1) The above alkene is oxidized to make an oxide. The oxide thus obtained is hydrolyzed to make an ethyleneglycol (OH—CH2-CH2-OH). Then, the above oxide is reacted with alcohol to make a diethyleneglycoldiemethylether (CH3-O—CH2CH2-O—CH2CH2-O—CH3).

(2) The above alkene is hydrated to make an alcohol (ROH).

(3) The above alcohol is dehydrated to make an ether (R—O—R).

(4) The alkene is ozone-decomposed to make an aldehyde or ketone.

Then, the aldehyde or ketone thus obtained is added with alcohol to make an acetal (RCH(OR')2), for example, acetaldehydediethylacetal (CH3CH (OCH2H5)2) or ketal ((R)2C (OR')2), for example, 2-2 diethoxypropene ((CH3)2C (OC2H5)2).

(5) The alkene is ozone-decomposed to make an aldehyde or ketone. The aldehyde or ketone thus obtained is oxidized to make a carboxylic acid. This carboxylic acid is reacted with the alcohol to make a methylacetate (CH3COOCH3) that is one kind of ester (R—COOCH3).

By doing so, glycol, alcohol, ether, acetal, ketal and ester are made using olefin-based hydrocarbon as a starting material. Then, one or two or more kinds of them are blended with kerosene, light oil or heavy oil to manufacture a low pollution fuel.

As one effective example, kerosene, light oil or heavy oil is blended with ether and/or alcohol to obtain a low pollution fuel.

As the ether, dimethylether dissolved in a solvent and liquefied is preferably used in consideration of economical performance and marketability. As the solvent, alkene, a mixture of alcohol and alkene, or alcohol, alkene or ketone is used.

Examples of such ether may include one or two or more kinds of diethylether, dipropylether, dibutylether, diethyleneglycol, diethyleneglycoldimethylether, diethyleneglycoldiethylether, diethyleneglycolmonoethylether, diethyleneglycolmonomethylether, and diethyleneglycolmonobutylether.

Combustion tests reveal the following facts. Of those ethers, diethyleneglycolmonoethylether, diethyleneglycolmonomethylether and diethyleneglycolmonobutylether having three or more oxygens O in a molecular formula are effective because they exhibit favorable self-combustibility and they are enriched with the effect for enhancing combustibility of kerosene, light oil or heavy oil.

As another example of the low pollution fuel, the kerosene, light oil or heavy oil contains one or two or more kinds of glycol, acetal, ketal or ester, which are obtained by the above-mentioned method, together with ether and alcohol.

As a further example of the low pollution fuel, a liquefied hydrocarbon as represented by kerosene, light oil or heavy oil contains one or two or more kinds of glycol, acetal, ketal or ester, without using the ether and alcohol.

The above-mentioned fuel is effective as a low pollution fuel for a diesel engine, in which ether and alcohol are synergistically acted such that they themselves are burnt to obviate imperfect combustion while enhancing the combustion efficiency of the kerosene, light oil or heavy oil.

Blending examples of the low pollution fuel are shown hereinafter in terms of weight %.

| | | |
|---|---|---|
| (1) | CnH2n + 2 (kerosene or light oil) | 60 to 90% |
| | CH3OH (alcohol) | 5 to 20% |
| | CH3OCH3 (dimethylether) | 5 to 20% |
| (2) | C2H5OC2H5 (diethylether) | 5 to 45% |
| | C4H9OH (alcohol) | 15 to 45% |
| | CnH2n + 2 (kerosene or light oil) | 10 to 80% |
| (3) | C3H7OC3H7 (dipropylether) | 5 to 45% |
| | C4H9OH (alcohol) | 15 to 45% |
| | CnH2n + 2 (kerosene or light oil) | 10 to 80% |
| (4) | C4H9OC4H9 (dibutylether) | 5 to 45% |
| | C2H5OH (alcohol) | 15 to 45% |
| | CnH2n + 2 (kerosene or light oil) | 10 to 80% |
| (5) | HO (CH2CH2O) 2H (diethyleneglycol) | 5 to 35% |
| | C2H5OH (alcohol) | 5 to 35% |
| | CnH2n + 2 (kerosene or light oil) | 30 to 90% |
| (6) | (CH3OCH2CH2) 2O (diethyleneglycoldimethylether) | 5 to 35% |
| | C2H5OH (alcohol) | 5 to 35% |
| | CnH2n + 2 (kerosene or light oil) | 30 to 90% |
| (7) | C2H5 (OCH2CH2) 2OH (diethyleneglycoldiethylether) | 5 to 35% |
| | C4H9OH (alcohol) | 10 to 35% |
| | CnH2n + 2 (kerosene or light oil) | 30 to 85% |
| (8) | C2H5OCH2CH2OCH2CH2OH (diethyleneglycolmonoethylether) | 5 to 35% |
| | C4H9OH (alcohol) | 10 to 35% |
| | CnH2n + 2 (kerosene or light oil) | 30 to 85% |
| (9) | CH3OCH2CH2OCH2CH2OH (diethyleneglycolmonomethylether) | 5 to 35% |
| | C4H9OH (alcohol) | 10 to 35% |
| | CnH2n + 2 (kerosene or light oil) | 30 to 85% |
| (10) | C4H9OCH2CH2OCH2CH2OH (diethyleneglycolmonobutyether) | 5 to 35% |
| | C4H9OH (alcohol) | 10 to 35% |
| | CnH2n + 2 (kerosene or light oil) | 30 to 85% |

-continued

| | | |
|---|---|---|
| (11) | HOCH2CH2OH (ethyleneglycol) | 5 to 35% |
| | C4H9OH (alcohol) | 10 to 35% |
| | CnH2n + 2 (kerosene or light oil) | 30 to 85% |
| (12) | CH3CH(OC2H5) 2 (acetaldehydediethylacetal) | 5 to 35% |
| | C4H9OC4H9 (dibutylether) | 2 to 8% |
| | C4H9OH (alcohol) | 10 to 35% |
| | CnH2n + 2 (kerosene or light oil) | 22 to 83% |
| (13) | C2H5COOCH3 (diethylcarbonate) | 5 to 35% |
| | C4H9OC4H9 (dibutylether) | 2 to 8% |
| | C4H9OH (alcohol) | 10 to 35% |
| | CnH2n + 2 (kerosene or light oil) | 22 to 83% |
| (14) | (R) 2C (OR') 2 (ketal) | 5 to 35% |
| | C4H9OH (alcohol) | 10 to 35% |
| | CnH2n + 2 (kerosene or light oil) | 30 to 85% |

The above molecular formula CnH2n+2 shows main components of kerosene or light oil, wherein n has a value in an allowable range of 9 to 22. In the case where heavy oil is used instead of the kerosene or light oil, the heavy oil is also used in terms of the weight % of the kerosene or light oil.

The low pollution fuel of the present invention exemplified in the above (1) to (14) is basically a blended fuel. Since no chemical reaction is required, manufacturing thereof can be made easily.

The liquefied dimethylether or diethylether, or diethyleneglycolmonoethylether, diethyleneglycolmonomethylether, or diethyleneglycolmonobutylether is an oxygen-contained compound. Those oxygen-contained compounds and kerosene, light oil or heavy oil are synergistically acted to enhance the combustion efficiency and they themselves are burnt to obviate the imperfect combustion of fuel, thereby fundamentally solving the exhaust gas problems without depending on the conventional symptomatic method.

The fuels of the above (1) to (14) can reduce, though slightly different from each other, about 30% to 60% of a discharged quantity of suspended particulate matter (PM), about 10% to 20% of a discharged quantity of nitrogen oxide (NOx), about 30% to 40% of a discharged quantity of hydrocarbon (HC) and about 10% to 20% of a discharged quantity of carbon monoxide which are contained in the exhaust gas of light oil which is currently used as the fuel for a diesel engine.

What is claimed is:

1. A fuel comprising kerosene, light oil or heavy oil, which contains at least one of diethyleneglycolmonoalkylether selected from diethyleneglycolmonoethylether, diethyleneglycolmonomethylether and diethyleneglycolmonobutylether; and which contains alcohol and dimethylether.

2. A fuel comprising kerosene, light oil or heavy oil, which contains at least one of a diethyleneglycolalkylether selected from diethyleneglycolmonoethylether, diethyleneglycolmonomethylether and diethyleneglycolmonobutylether, and which contains at least one of glycol, acetal, ketal and ester.

* * * * *